US005190373A

United States Patent [19]

Dickson et al.

[11] Patent Number: 5,190,373

[45] Date of Patent: Mar. 2, 1993

[54] METHOD, APPARATUS, AND ARTICLE FOR FORMING A HEATED, PRESSURIZED MIXTURE OF FLUIDS

[75] Inventors: Donald J. Dickson, Charleston; Marcelo J. Marchetti, Kanawha, both of W. Va.

[73] Assignee: Union Carbide Chemicals & Plastics Technology Corporation, Danbury, Conn.

[21] Appl. No.: 813,023

[22] Filed: Dec. 24, 1991

[51] Int. Cl.[5] ..... B01F 15/05; B01F 5/18

[52] U.S. Cl. ..... 366/146; 366/333; 366/605

[58] Field of Search ..... 366/255, 256, 257, 258, 366/259, 260, 332, 333, 334, 335, 605, 144, 146, 145; 239/432

[56] References Cited

U.S. PATENT DOCUMENTS

| | | | |
|---|---|---|---|
| 1,981,623 | 11/1934 | Karter | 299/33 |
| 3,163,360 | 12/1964 | McNinch, Jr. et al. | 239/124 |
| 3,229,911 | 1/1966 | Carlson | 239/142 |
| 3,317,141 | 5/1967 | Mann | 239/127 |
| 3,684,250 | 8/1972 | Roeser | 366/161 |
| 3,705,687 | 12/1972 | Vicentini et al. | 239/92 |
| 4,096,585 | 6/1978 | Florentini | 366/144 |
| 4,347,002 | 8/1982 | Born | 366/332 |
| 4,401,268 | 8/1983 | Pomponi, Jr. | 239/142 |
| 4,702,416 | 10/1987 | Pagliai et al. | 239/11 |
| 4,708,088 | 11/1987 | Purivs et al. | 118/300 |
| 4,789,100 | 12/1988 | Senf | 239/432 |
| 4,798,333 | 1/1989 | Luchsinger | 239/142 |

*Primary Examiner*—Robert W. Jenkins
*Attorney, Agent, or Firm*—J. F. Leightner

[57] ABSTRACT

The invention relates to method and small batch, portable apparatus and article for heating, pressurizing and continuously mixing two fluids, preferably at least one compressible fluid and one non-compressible fluid in a single vessel to form a mixture of such fluids.

11 Claims, 2 Drawing Sheets

METHOD, APPARATUS, AND ARTICLE FOR FORMING A HEATED, PRESSURIZED MIXTURE OF FLUIDS

FIELD OF THE INVENTION

This invention relates to method and apparatus for effectively mixing, heating and pressurizing at least two fluids on a small batch basis. The present invention also relates to a portable batch type apparatus and article for forming a heated and pressurized coating composition mixture containing a substantially accurately proportioned amount of at least one supercritical fluid used as a viscosity reduction diluent. The resultant mixture can then be sprayed onto a substrate to be coated.

BACKGROUND OF THE INVENTION

U.S. Pat. No. 4,923,720 issued May 8, 1990, describes an invention for the liquid spray applications of coatings such as lacquers, enamels and varnishes using an environmentally safe, non-polluting diluent that can be used to thin highly viscous polymers and coating compositions to liquid spray application consistency. The '720 patent describes the utilization of supercritical fluids, such as supercritical carbon dioxide fluid as diluents in highly viscous organic solvent borne and/or highly viscous non-aqueous dispersion coating compositions to dilute these compositions to application viscosity required for liquid spray techniques, thereby substantially reducing the amount of volatile organic compounds (VOC) emissions from coating applications. To the extent a knowledge of the supercritical fluid phenomena is necessary for the understanding of this invention and the need that it fulfills, the disclosure of the '720 patent is incorporated herein by reference.

Apparatus for practicing the invention described in the '720 patent is described in U.S. patent application Ser. No. 413,517, filed Sep. 27, 1989. Apparatus and methods are disclosed for accurately and continuously providing a proportionated mixture comprised of non-compressible fluid and compressible fluid for spraying upon a substrate to be coated, relying particularly upon mass proportionation, to obtain the desired mixture of the compressible and non-compressible fluids.

As used in that application and as used herein the phrase "compressible fluid" is meant to include a material whose density is affected by a change in pressure to an extent of at least about 2 percent.

Specifically, the mass flow rate of the compressible fluid is continuously and instantaneously measured. Regardless of what that flow rate is and whether or not it is fluctuating as a result of, for example, being pumped by a reciprocating pump or regardless of the state of such compressible fluid, that mass flow rate information is fed to a signal processor on a continuous and instantaneous manner. Based on that received information, the signal processor in response to the amount of compressible fluid that has been measured, controls a metering device which controls the rate of flow of the non-compressible fluid. The non-compressible fluid is then metered in a precise predetermined proportion relative to the compressible fluid flow rate such that when the compressible and non-compressible fluids are subsequently mixed, they are present in the admixed coating formulation in the proper proportions.

The apparatus and methods disclosed in U.S. patent application Ser. No. 413,517, however, are particularly effective and specifically focused for producing the desired proportionated mixture of compressible and non-compressible fluids on a relatively large scale, continuous basis. The inventions disclosed in that Application are most suitable for substantially large industrial facilities wherein the substrate to be coated typically is transported on a conveyor system past one or more spray guns, which may be stationary or moving, to be sprayed by the apparatus disclosed therein. Such systems, and the like, may generally be used to coat automobile parts; electric motors; containers; pipe; coil steel, paper, fabric and other materials that are coated as they are rewound; plywood; porcelain enameling stove parts; adhesive on panels and honeycomb for laminating; sheet metal parts such as washers, dryers, refrigerators and the like; automotive bodies; furniture, case goods; and heavy machinery.

There are applications, however, that the continuous apparatus of the scale and sophistication envisaged in U.S. patent application Ser. No. 413,517 cannot meet in a practical and economical manner. Thus, for example, the automobile refinish industry, and small "end-use" shop and field spraying operations, and the like, where "economics-of-scale" dictate low cost equipment and a simple mode of operation, cannot effectively utilize the type of equipment disclosed in U.S. patent application Ser. No. 413,517. What was needed was a simple, semi-continuous method and apparatus, which was portable and small in scale.

Although smaller in size, such a system still must be able to feed, accurately proportion, pressurize, heat and mix a plurality of fluids, particularly one or more compressible fluids with one or more non-compressible fluids, and then be able to spray such mixed, heated and pressurized fluids through a spray gun. Most preferably, this relatively small-scale, semi-continuous unit should be able to accurately proportion, pressurize, heat and mix a coating material with a supercritical fluid, such as supercritical carbon dioxide, and spray such a mixture at supercritical conditions. Moreover, the apparatus should also be able to avoid settling of the contents of the mixed fluids such as when preparing, for example, a pigmented coating system; be easily cleaned when color changes are necessary; minimize the amount of solvent emissions to the environment; have a minimum of dead space; provide for circulating the coating fluid continuously through the spray system and gun to maintain precise temperature and pressure control; and have a minimum of moving parts requiring seals from which leaks may occur.

That need was met in U.S. patent application Ser. No. 544,777, filed Jun. 27, 1990, now U.S. Pat. No. 5,098,194 which describes apparatus which is more economical and practical for use in automobile refinishing and small "end-use" shop and field spraying operations and the like where "economics-of-scale" dictate low cost equipment and a simple mode of operation. The apparatus therein described is portable and small in scale; for example, about but not restricted to a fluid output of about 0.01 to 0.2 gallons per minute and a total capacity of about 0.1 to 1 gallon in the spraying system.

The invention described in U.S. patent application Ser. No. 544,777, now U.S. Pat. No. 5,098,194, involves introducing two or more fluids into two or more vessels capable of being pressurized. The fluids are then oscillated from one vessel to the other. Mixing of the fluids is accomplished by the oscillation itself. Pressurization of the vessels is accomplished by a hydraulic system.

Although the apparatus of U.S. patent application Ser. No. 544,777, now U.S. Pat. No. 5,098,194, satisfied many of the needs for smaller scale applications discussed above there still remains a need to simplify the apparatus. The above apparatus utilizes an hydraulic system to accomplish pressurization, mixing and circulation of the fluids. Additionally, the apparatus uses two high pressure accumulators and an oscillation loop to provide mixing. The use of a hydraulic system complicates the apparatus and the hydraulic fluid is a potential source of contamination of the coating material.

Accordingly, there is a need for a small portable batch-type apparatus that can achieve the results of the prior apparatus, but in a simpler and more economical manner.

SUMMARY OF THE INVENTION

By virtue of the present invention, essentially all of the above needs have now been met. Method and apparatus has been discovered which are capable, on a batch basis, of accurately providing a heated and pressurized mixture of a plurality of fluids. While the present invention may be utilized with any combination of fluids, it is particularly advantageous for use with a mixture of non-compressible and compressible fluids, and features the formation of a mixture, preferably a proportioned mixture of coating formulation and a supercritical fluid, such as supercritical carbon dioxide, which is sprayed onto a substrate.

In one aspect of the invention a portable easily transportable article of manufacture is provided which comprises a vessel containing an accurately proportioned mixture of a plurality of fluids, preferably at least one compressible and at least one non-compressible fluid. The vessel also contains mixing means and means for maintaining substantially constant pressure in the vessel, both means being adapted to be connected at the point of use to a means for operating the mixing means and to a means for operating the pressure maintaining means in the vessel.

In another aspect, the present invention involves a method wherein a predetermined, proportionated amount of two or more fluids is supplied to the chamber of a vessel capable of being pressurized. The fluids are then continuously mixed by a reciprocating mixing means which may be a paddle of various designs. The fluids are pressurized and the pressure is adjusted to arrive at a predetermined substantially constant final system pressure for the ultimate product mixture. The mixed fluids are heated in the vessel to maintain the temperature required during the spraying operation. The mixed, heated and pressurized fluids are then discharged from the vessel to the substrate to be coated.

In another aspect, the present invention provides an apparatus for mixing, heating and pressurizing two or more fluids which apparatus comprises:

a vessel having a chamber sealed at one end;

pressurizing means located in said chamber and capable of reciprocal movement in said chamber;

first inlet means for introducing fluids into said chamber on one side of said pressurizing means;

means on said first inlet means side of said pressurizing means for continuously mixing said fluids in said chamber to form a mixture;

means attached to said mixing means for reciprocally moving said mixing means along the length of said chamber;

means for heating said coating mixture in said chamber;

outlet means for discharging the coating mixture from said chamber; and second inlet means located on the other side of said pressurizing means for introducing pressurizing force means for moving said pressurizing means in said chamber in order to maintain substantially constant pressure as said mixture is discharged therefrom.

The small-scale batch apparatus of the present invention, particularly by enabling the use of commercially available vessels such as, for example, accumulators which are here used in a novel manner, allows for simplicity, efficiency and portability. It also facilitates purging the apparatus for cleanup, such that minimum organic solvent is required thereby minimizing the undesirable release of solvent to the environment. This is particularly desirable where the apparatus is to be cleaned for color change purposes when coating formulation is being utilized.

While the prior art discloses apparatus for porportioning and mixing fluids using accumulators and mass balances, it does not disclose apparatus including a single accumulator vessel which serves two functions simultaneously, that is to both deliver a fluid mixture at a specified pressure and, at the same time, continuously mix the proportional amounts of components of a fluid mixture within the accumulator chamber, especially when one of the components is a compressible supercritical fluid such as carbon dioxide.

DETAILED DESCRIPTION OF THE INVENTION AND PREFERRED EMBODIMENTS THEREOF

It is to be understood that while the following discussion will primarily focus upon providing a proportionated admixed liquid mixture of a coating formulation and supercritical fluid, such as carbon dioxide, which is suitable for being sprayed onto a substrate, the present invention is in no way limited to this preferred embodiment. As is readily apparent from the foregoing discussion, the present invention encompasses the mixing, heating and pressurization of any plurality of fluids, but is particularly advantageous for preparing a mixture of compressible and non-compressible fluids, to form a desired mixture for any intended subsequent use.

Figure 1:
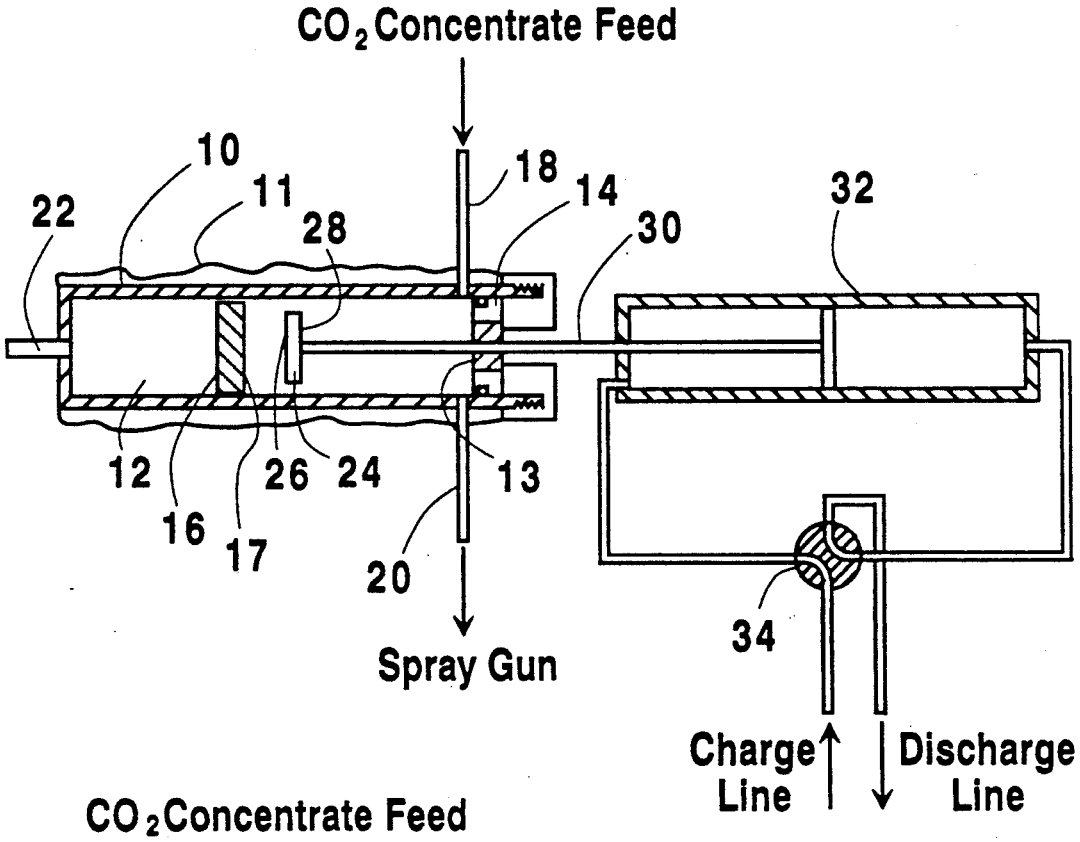
FIG. 1 is a schematic representation of the basic apparatus of the invention.

Referring to the drawings and more particularly FIG. 1, the apparatus of the invention includes a pressure vessel 10 having a chamber 12 therein, preferably in the form of an accumulator. The vessel is wrapped with a heating tape 11 adapted to be connected to an electrical source of power. The open end of the accumulator is sealed by sealing wall 14 having an inside face 13. A moveable piston-like member 16 having a front face 17 is moveably mounted in chamber 12 and is capable of reciprocal movement in chamber 12. An inlet means 18 to and an outlet means 20 from chamber 12 are located in said accumulator 10 on one side of the moveable piston-like member 16. Another inlet 22 to chamber 12 is located in accumulator 10 on the other side of the moveable piston-like member 16. A mixing paddle 24 having a front face 26 and a back face 28 is located in chamber 12 and is mounted on a shaft 30 extending into chamber 12 through the sealing wall 14. The shaft 30, in one embodiment, is adapted to be connected to a motor 32. The action of motor 32 is obtained by reversing flow of fluid to the motor 32 by a four-way valve 34 controlled by a pressure sensor, not shown in FIG. 1, in the charge line to valve 34.

In operation, a predetermined proportioned amount of a fluid mixture obtained from apparatus known in the prior art, such as described in aforementioned U.S. patent application Ser. No. 413,517, is charged to the chamber 12 through inlet 18. The so-charged vessel can be transported to a point of use where the accumulator vessel may be connected to: a spray gun through outlet 20; to motor or other driving means by shaft 30; to pressurizing fluid through inlet 22; and to a power source for heating the heating tape 11 and consequently the mixture in the vessel and for maintaining the temperature required during the spraying operation.

Of course, the accumulator can be part of a system wherein the accumulator is connected to a motor, heating means and pressurizing gas source. The entire system may be mounted on a moveable skid and moved to a point of use.

After the vessel 10 has been connected as set forth above, the fluid mixture from chamber 12 is delivered to a spray gun through outlet 20 at a substantially constant specified pressure by introducing a pressuring force means, preferably nitrogen gas, through inlet 22 to drive piston-like member 16. As the fluid mixture is fed to a spray gun the loss in pressure within chamber 12 is counteracted by the pressure of the nitrogen gas which moves member 16 to keep the chamber 12 and fluid mixture at a specific pressure. Simultaneously, mixing paddle 24 mounted on shaft 30, is operated, in one embodiment, by motor 32 and is continuously moved, reciprocially, by reversing flow of fluid to the motor 32 through valve 34 to continuously mix the fluids introduced into chamber 12 through inlet 18. The motor 32 can be driven by any conventional means such as air or electricity. The motor 32 is controlled by pressure sensors, such as described in FIG. 4, which can sense the pressure inside chamber 12. Thus when face 26 of mixing paddle 24 just about reaches member 16, the pressure sensor detects the increase in pressure and causes motor 32 to reverse and correspondingly the mixing paddle 24 reverses its stroke. Similarly, when back face 28 of mixing paddle 24 reaches sealing wall 14, the pressure sensor detects this and instantly reverses the direction of the mixing paddle 24. In this manner the fluids in chamber 12 are continuously mixed throughout a range of operations of varying stroke length of reciprocating movement of shaft 30 while being under substantially constant pressure.

As indicated above, nitrogen is the preferred means for maintaining the supercritical pressure in the accumulator chamber. The use of nitrogen allows for an extremely simple system requiring only a regulator to fix the desired pressure in the accumulator. The use of nitrogen does require the regular supply of nitrogen cylinders. Compressed air can also be used, but while it eliminates the need for cylinders, it requires the addition of an air compressor. Both these alternatives, however, are simpler than a hydraulic fluid system which may also be used with the invention. Hydraulic fluid may be used as the heating medium for maintaining the required temperature in the accumulator. Nitrogen or compressed air may also be used as a heating medium, but at low energy.

Figure 2:
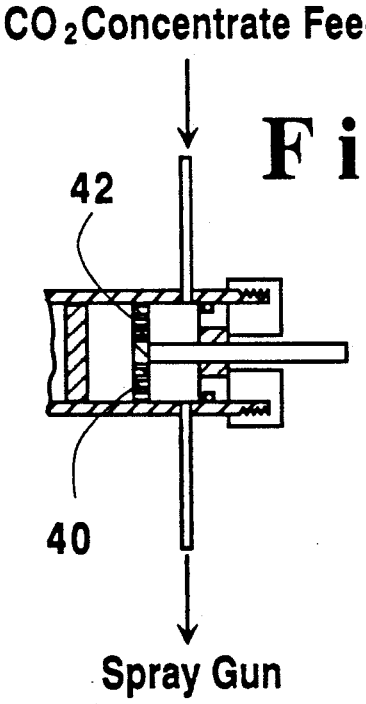
FIGS. 2 and 3 are schematic drawings of variations of the mixing paddle of the invention.
Figure 3:
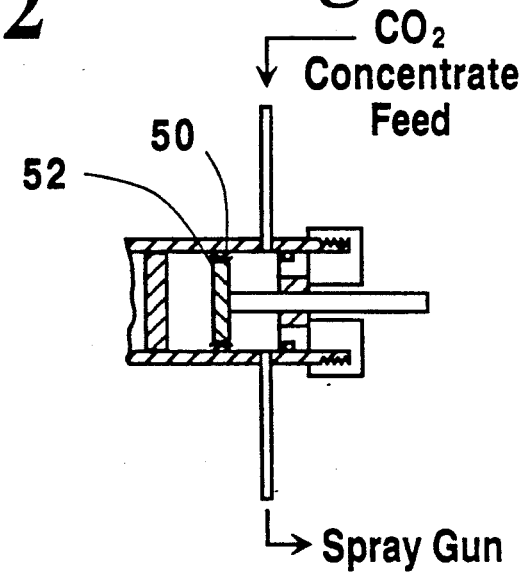

FIGS. 2 and 3 illustrate alternative embodiments of the paddle 24 shown in FIG. 1. The paddle 24 in FIG. 1 is solid with side clearance to allow circulation of the fluids. Mixing of the fluids is aided by restricting circulation through this clearance.

FIG. 2 illustrates a perforated paddle 40 without side clearance. The fluids are forced to circulate through the holes 42 and mixed.

FIG. 3 shows another variation of the paddle 24 in FIG. 1. The side clearance in this embodiment is restricted by placing flow deflectors 50 around the circumference of the paddle 52. The fluid mixing is enhanced by circulation through the restricted side clearance and deflectors.

Figure 4:
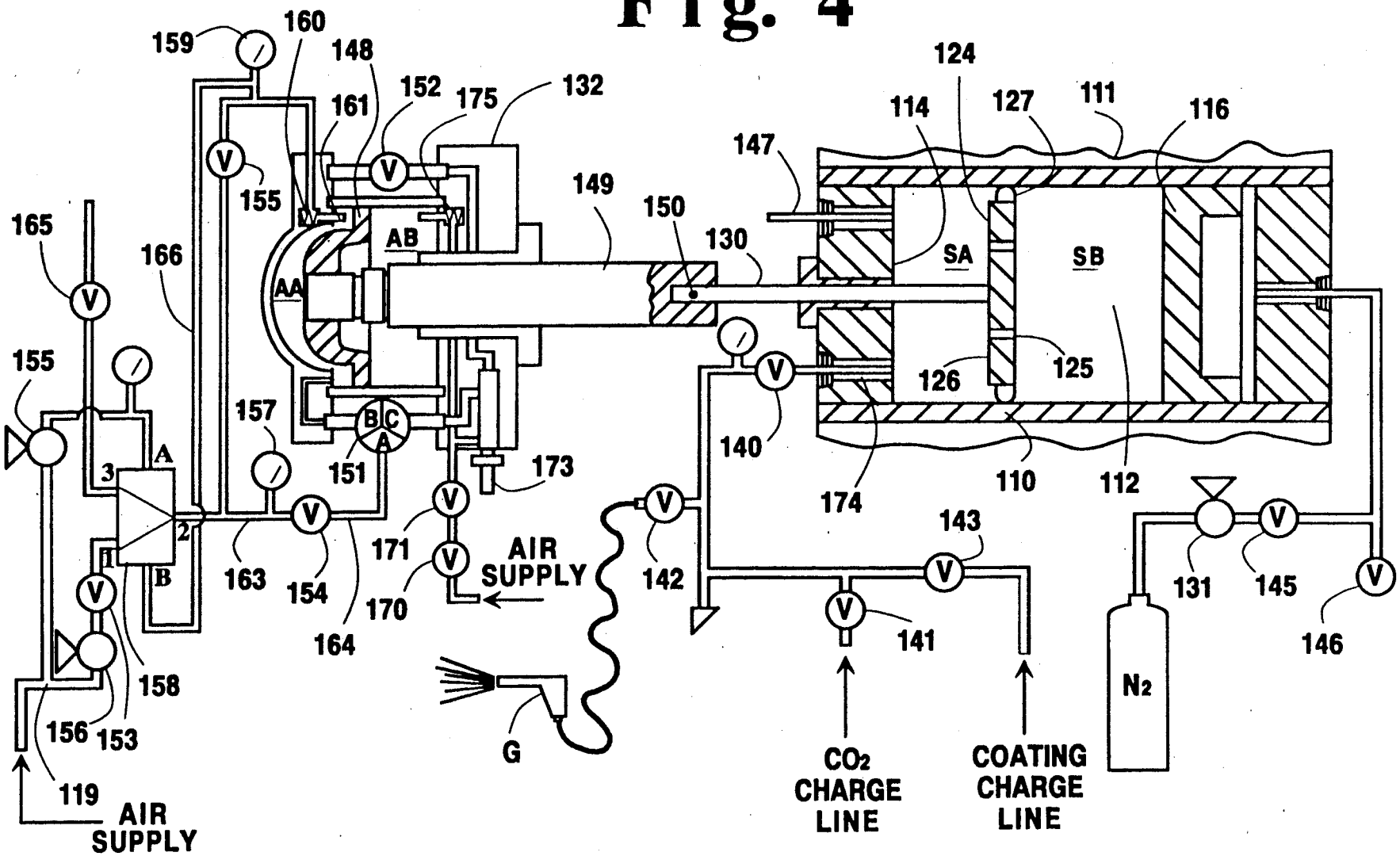
FIG. 4 is a schematic diagram of a system of the invention.

Referring now to FIG. 4, which illustrates a preferred embodiment of the system of the invention, the operation of the system will be described. Common elements of the apparatus with those shown in FIG. 1 have the same reference numerals except each is increased by 100.

The design of the system is based on the need to continuously mix the fluid in chamber 112 of the coating accumulator 110 by reciprocating motion of piston 124 during spraying of the contents. As contents are sprayed, the piston 116 moves towards the seal end 114 of the accumulator 110 as nitrogen pressure maintains a constant pressure by replacing the volume sprayed.

To initiate mixing and spraying operation outlet side SA of the coating accumulator 110 is evacuated to a moderate vacuum (such as 1 psia) using standard lab vacuum apparatus by opening Valve 140 leading from side SA and valve 141 in $CO_2$ charge line. All valves are preferably ball valves, unless otherwise noted. In order to charge coating material to the accumulator 110, valves 140 and 143 are opened and valves 141 and 142 are closed. For this operation, coating material is charged from a mass measuring system such as described in aforementioned U.S. patent application Ser. No. 413,517. Following the coating charge, valve 143 is closed, valve 141 is opened, and carbon dioxide is similarly charged by a mass loading system such as described in the aforementioned application. Following proper charge, the valves 140, 141, 142 and 143 are closed.

Next, nitrogen is charged to the accumulator 110 by opening valve 145, closing valve 146 and regulating the pressure through flow regulator 131. Pressure is typically in the range of from about 1,000 to about 2,000 psi and for this example is 1,700 psi. The admission of nitrogen to side SB of the accumulator 110 causes the piston 116 to move in chamber 112 towards side SA and compress the coatings and carbon dioxide mixture previously loaded into the side SA of the chamber 112 in accumulator 110 to a pressure equal to the nitrogen charging pressure which, as stated above, is 1,700 psi in this case.

Upon pressurization of the contents of the coating accumulator 110, heat is then applied via heat tape 111 surrounding the accumulator 110 and temperature is measured via thermocouple 147. Temperature is regulated to a desirable temperature in the range of 30°-50° C.

Mixing of the coating and carbon dioxide materials is accomplished by movement of piston 124 back and forth through the contents of fluid contained in chamber 112. Several means may be provided by various design (as described and shown in FIGS. 2, 3 and 4) of piston 124 to assure effective mixing. Holes 125 drilled through piston 124 and relatively small clearances 127 between the diameter of piston 124 and the inside diameter of the chamber 112 are shown in FIG. 4.

The movement of piston 124 is provided by the air motor piston 148 via shafts 130 and 149 connected by pin 150. The operation of the air motor 132 which in this embodiment is a Haskel Pump Model DSF-35, is described by beginning with the accumulator piston 124 at the end of the stroke nearest the seal wall 114 and air motor piston 148 at end AA of air motor 132.

For this operation, three-way valve 151 is activated so that fluid passage from port A to port B is opened and fluid passages from port B to port C and from port A to port C is closed. Also valve 152 is closed. Needle valve 153 located in the air supply line 119 and ball valve 154 located in line 163 are opened. Air (at a nominal 100 psi pressure) is supplied to regulators 155 and 156. Pressure regulator 156 is adjusted to approximately 80 psi and pressure regulator 155 is adjusted to approximately 60 psi. Needle valve 153 is then opened and adjusted to regulate pressure during piston movement at pressure gauge 157 to a pressure below that of regulator 155 (for example, approximately 40 psig). In this embodiment, air is supplied through regulator 156 and flows through needle valve 153, through air relay 158 (which is indicated in the drawing as an internal pilot valve which in this position opens fluid passage from port 1 to port 2 and closes fluid passage from port 2 to port 3). Air thereby enters the piping system 163, 164 and also 166 through ball valve 154 and check valve 155. Fluid entering the piping system 164 through ball valve 154 proceeds through three-way valve 151 entering port A and exiting port B and thus entering the air chamber AA of the air motor 132. Needle valve 153 is adjusted as described above so that air entering chamber AA moves the piston towards chamber AB with a pressure in piping system 163, 164 and 166 and also on pressure gauge 157 of approximately 40 psi. The diameter of the air motor is selected so that this pressure (40 psi) times the cross-sectional area of the air motor piston 148 is sufficient to overcome the static force created by the pressure in the coating accumulator times the cross-sectional area of the shaft 130, (0.4375 dia.) thus generating a hydraulic force on shaft 130 towards the piston 116 in accumulator 110 (in this embodiment, 235 pounds). This movement actuates shafts 149 and 130 and the piston 124 in the coating accumulator 110, thus causing it to move in the direction of the accumulator piston 116.

When accumulator piston 124 reaches piston 116, the motion of piston 124 and air motor piston 148 essentially ceases. Pressure in chamber AA thereafter rises from 40 psig to a pressure which may be as high as regulated by regulator 156 air supply pressure of 80 psi.

Now set forth is a description of the actions of check valve 155 and spring loaded flow valve 160. In this operating mode, piping system 166 and pressure gauge 159 is exposed to identical fluid pressure as pressure gauge 157. Air flow enters temporarily confined piping system 166 through check valve 155. The piping system 166 is temporarily confined by port B of air relay 158, check valve 155 and a spring-loaded valve 160. Therefore, as pressure increases from, for example, 40 psi to 80 psi, pressure is transmitted through check valve 155 to piping system 166 and is transmitted to port B of the air relay valve 158.

When the pressure at port B exceeds the pressure at port A (previously adjusted to 60 psi) the pilot assembly in air relay 158 shifts from the B side to the A side, thereby opening the fluid passage from port 3 to port 2 and closing the fluid passage from port 1 to port 2. This completes the travel of piston 148 from side AA to AB in air motor 132.

Upon shifting the relay valve in relay 158 from side B to side A, air pressure previously contained in side AA of the piston is exhausted through 3-way ball valve 151, line 164, valve 154, line 163, and air relay 158 through ports 2 and 3 to needle valve 165 and vented to the atmosphere. Needle valve 165 is adjusted to control the rate of air flow and thereby control the velocity of piston travel in the air motor 132 from side AB to side AA.

The next operation of air valve 160 completes this stroke cycle. During this stroke, the air pressure (as measured on pressure gauge 159 and contained in a piping system 166) remains constant at a pressure slightly in excess of 60 psi. When piston 148 moves fully in the direction of chamber AA, piston 148 strikes the mechanical actuator 161 of valve 160, thus opening the valve seat and permitting air temporarily confined in line 166 to be vented into chamber AA of the air motor. This reduction in pressure is communicated via line 166 to port B of the relay valve 158. When the pressure at port B is lower than the pressure provided to port A by flow regulator 155 (40 Psi), then the relay valve of relay 158 moves from Position A to Position B where fluid passage from port 1 to port 2 is opened and fluid passage from port 3 to port 2 is closed, thus renewing the cycle.

Upon thorough mixing of the coating material, the mixed coating material is sprayed by opening valves 140 and 142 and spraying through spray gun G. Constant pressure is maintained on the coating mixture by the influence of constant nitrogen pressure causing piston 116 to move towards chamber SA as contents of chamber 112 are depleted.

The design of piston 124, chamber 112 and piston 116 is such as to completely empty the contents of the accumulator 110 except for small amounts of coating material which remains in mixing holes 125, clearance 127 and relief on piston face 126 which is provided to assure a flow path for coating material to the drilled port 174 opening to valve 140.

When the spray is completed, nitrogen pressure is removed from the accumulator 110 by closing valve 145, and opening valve 146.

For clean-up of the coating accumulator, following the spray of the contents, suitable solvent, for example a mixture of solvent and carbon dioxide is added to chamber 112. This procedure may be conducted at elevated pressures and operated as previously described for spraying operations or may be conducted at atmospheric pressures, and operated as described hereinafter.

The admission of solvent forces the piston 116 toward chamber SB. To clean the coating accumulator, chamber 112 must be fully filled with solvent thus moving piston 116 fully towards chamber SB.

For clean-up operation under low pressure, three-way ball valve 151 is adjusted so that flow passage from port B to port C is opened and flow passage from port A to port B or port A to port C is closed. Also ball valve 152 is opened. During this operating mode, 100 psi air, for example. is admitted through ball valve 170 and needle valve 171 and is vented to the atmosphere through exhaust 173. Nitrogen is not supplied to chamber SB of the coating accumulator 112, i.e., valve 145 is closed and valve 146 is opened.

This air motor is designed to automatically reciprocate through its designed stroke length through the alternating application of supplied air from side AA or side AB and by venting the other side through a pilot-type pneumatic relay valve. Valves 160 and 175 sense proximity of piston 148 by striking for example, the pin 161 in valve 160 which opens the valve. The actuation of valves 160 and 175 provides air signals to operate the pilot type pneumatic relay valve. The operation of the air motor in this mode is sufficient to move piston 148 and, therefore, piston 124 of the coating accumulator 110 back and forth through its entire stroke, thereby mixing any coating residue in clean-up solvent and permitting the thorough cleaning of the chamber 112 of the coating accumulator 110.

Clean-up is completed by adding nitrogen pressure by closing valve 146, opening valve 145, and regulating moderate nitrogen pressure, then opening valve 145 and valve 140 and spraying out the contents of the coating accumulator 110 via spray gun G.

The coating accumulator 110 described herein may be removed from the air motor assembly by: removing pin 150; coating tubing from valve 140; nitrogen tubing from valve 145; electric power to (unplug) heat tape 111; and disconnecting thermocouple 147.

In this mode, the coating accumulator 110 will serve as a transportable container which may be taken to a facility where specific coatings or other materials and carbon dioxide may be filled in required quantities and proportions.

Thus filled, the coating accumulator 110 may be transported to a point of use where it is reconnected to an air motor (the reverse of that described above) and contents can be pressurized, heated, mixed and sprayed.

This system allows the practical implementation of a new coating delivery system where specially formulated, high solids coating materials (in the 1,000 to 10,000 cp range) may be specially blended for such uses as color selection and accurately metered and thoroughly mixed for specific end uses.

Having described the invention with reference to the drawings and certain preferred embodiments and best mode of operation it will be obvious to one skilled in the art to make minor modifications to the elements of the invention or the arrangement thereof without departing from the spirit and scope of this invention.

We claim:

1. Apparatus for mixing, heating and pressurizing at least two fluids comprising:

a vessel having a chamber sealed at one end;

pressurizing means located in said chamber and capable of reciprocal movement in said chamber;

first inlet means for introducing fluids into said chamber on one side of said pressurizing means;

means on said first inlet means side of said pressurizing means for continuously mixing said fluids in said chamber to form a mixture;

means attached to said mixing means for continuously reciprocally moving said mixing means along the length of said chamber;

means for heating said mixture in said chamber;.

outlet means for discharging the continuously mixed mixture from said chamber; and second inlet means located on the other side of pressurizing means for introducing pressurizing force means for moving said pressurizing means in said chamber in order to maintain substantially constant pressure as said mixture is discharged therefrom.

2. Apparatus according to claim 1 wherein said vessel is an accumulator.

3. Apparatus according to claim 1 wherein said mixing means is a solid paddle of slightly smaller size than the chamber to provide a side clearance to allow circulation of fluids in the chamber.

4. Apparatus according to claim 3 wherein deflectors are mounted on the paddle in the side clearance.

5. Apparatus according to claim 3 wherein said paddle is perforated and there is essentially no side clearance with the chamber walls.

6. Apparatus according to claim 1 wherein said means for reciprocally moving said mixing means is a motor.

7. Apparatus according to claim 1 wherein said pressurizing force means is a fluid selected from the group consisting of air, nitrogen and a hydraulic fluid.

8. Apparatus according to claim 7 wherein said pressurizing force means is nitrogen.

9. Apparatus for mixing, heating and pressurizing at least one compressible fluid and at least one non-compressible fluid to form a mixture for spraying onto a substrate to be coated; comprising:

a vessel having a chamber sealed at one end;

pressurizing means located in said chamber and capable of reciprocal movement in said chamber;

first inlet means for introducing at least one compressible fluid and at least one non-compressible fluid into said chamber on one side of said pressurizing means;

means on said first inlet means side of said pressurizing means for continuously mixing said fluids in said chamber to form a mixture;

means attached to said mixing means for continuously reciprocally moving said mixing means along the length of said chamber;

means for heating said mixture in said chamber;

outlet means for discharging the continuously mixed mixture from said chamber; and second inlet means located on the other side of said pressurizing means for introducing pressurizing force means for moving said pressurizing means in said chamber in order to maintain substantially constant pressure as said mixture is discharged therefrom.

10. An article for use in spray coating a substrate with a coating mixture consisting of at least one compressible fluid and at least one non-compressible fluid, which comprises:

a vessel having a charge therein of a predetermined proportioned amount of at least one compressible fluid and at least one non-compressible fluid;

a pressurizing means in said vessel adapted to be connected to a pressurizing force means on one side of said pressurizing means;

a mixing means in said vessel on the other side of said pressurizing means adapted to be connected to a means for operating said mixing means to continuously mix said fluids; and outlet means on said other side of said pressurizing means for connecting said vessel to a spray gun.

11. A method for mixing, heating and pressurizing at least one compressible fluid and at least one non-compressible fluid comprising:

supplying a proportional amount of at least one compressible fluid and at least one non-compressible fluid to a vessel;

continuously mixing said fluids in said vessel;

heating said fluids in said vessel as they are continuously mixed;

discharging the mixed fluids from the vessel; and continuously maintaining the pressure in the vessel as the mixed fluids are being discharged therefrom.

* * * * *